US010163432B2

(12) United States Patent
Every

(10) Patent No.: US 10,163,432 B2
(45) Date of Patent: Dec. 25, 2018

(54) ACTIVE NOISE CONTROL USING VARIABLE STEP-SIZE ADAPTATION

(71) Applicant: 2236008 Ontario Inc., Waterloo (CA)

(72) Inventor: Mark Robert Every, Surrey (CA)

(73) Assignee: 2236008 Ontario Inc., Waterloo (CA)

( * ) Notice: Subject to any disclaimer, the term of this patent is extended or adjusted under 35 U.S.C. 154(b) by 0 days.

(21) Appl. No.: 15/440,977

(22) Filed: Feb. 23, 2017

(65) Prior Publication Data

US 2018/0240452 A1 Aug. 23, 2018

(51) Int. Cl.
*G10K 11/178* (2006.01)

(52) U.S. Cl.
CPC .... *G10K 11/178* (2013.01); *G10K 2210/1282* (2013.01); *G10K 2210/12821* (2013.01); *G10K 2210/3028* (2013.01); *G10K 2210/3046* (2013.01); *G10K 2210/3054* (2013.01); *G10K 2210/3055* (2013.01)

(58) Field of Classification Search
CPC ..... G10K 11/17823; G10K 11/17825; G10K 11/17833; G10K 11/17881; G10K 11/17885; G10K 11/1784; G10K 11/17854; G10K 11/17817; G10K 2210/3022; G10K 2210/3026; G10K 2210/3027; G10K 2210/3028; G10K 2210/3045; G10K 2210/3047; G10K 2210/1282; G10K 11/178; G10K 2210/3054; G10K 2210/3055; G10K 11/17879; G10K 2210/3025; G10K 2210/3046; G10K 2210/3056; H04R 1/1083
USPC ..... 381/71.11, 71.1, 94.1, 86, 93; 704/E21.014; 375/232; 379/406.08, 379/406.09
See application file for complete search history.

(56) References Cited

U.S. PATENT DOCUMENTS 5,469,510 A * 11/1995 Blind ..... H03G 9/005 381/55
6,772,074 B2 * 8/2004 Millott ..... F16F 15/00 702/56

(Continued)

OTHER PUBLICATIONS

Liang Wang et al: "Convergence Analysis of Narrowband Active Noise Equalizer System Under Imperfect Secondary Path Estimation", IEEE Transactions on Audio, Speech and Language Processing, IEEE, vol. 17, No. 4, May 1, 2009 (May 1, 2009), pp. 566-571, XP011253705; ISSN: 1558-7916, DOI: 10.1109/TASL.2008.2009018 * section C; p. 592—col. 1 ** figure 1 *.

(Continued)

*Primary Examiner* — Yogeshkumar Patel
(74) *Attorney, Agent, or Firm* — Ridout and Maybee LLP

(57) ABSTRACT

A system and method (referred to as the system) that actively reduces noise in a vehicle. The system generates one or more control output signals to drive multiple loudspeakers; and adapts multiple control coefficients of a control filter based on multiple secondary path transfer functions. The secondary path transfer functions model the acoustic paths between each loudspeaker and multiple microphones. The multiple control coefficients are time varying and frequency dependent and the rate the plurality control coefficients adapt is based on an adaptive step size based on one or more step size criteria.

21 Claims, 6 Drawing Sheets

(56) References Cited

U.S. PATENT DOCUMENTS 7,197,147 B2 * 3/2007 Millott ..... F16F 15/00 381/71.8
7,317,754 B1 * 1/2008 Remy ..... H04L 1/0002 375/222
8,306,240 B2 * 11/2012 Pan ..... G10K 11/178 381/94.1
8,355,512 B2 * 1/2013 Pan ..... G10K 11/178 381/71.11
9,240,819 B1 * 1/2016 Ku ..... H04B 1/62
2003/0163296 A1 * 8/2003 Richards ..... G06F 17/5036 703/14
2005/0053244 A1 * 3/2005 Onishi ..... G10K 11/17883 381/71.11
2005/0163251 A1 * 7/2005 McCallister ..... H03F 1/3247 375/296
2005/0163252 A1 * 7/2005 McCallister ..... H03F 1/3247 375/296
2005/0163268 A1 * 7/2005 McCallister ..... H03F 1/3247 375/346
2005/0207585 A1 * 9/2005 Christoph ..... G10K 11/178 381/71.11
2007/0233478 A1 * 10/2007 Sakamoto ..... G10K 11/178 704/233
2008/0031468 A1 * 2/2008 Christoph ..... G10K 11/178 381/71.2
2008/0144853 A1 6/2008 Sommerfeldt et al.
2008/0181422 A1 * 7/2008 Christoph ..... G10K 11/17817 381/73.1
2008/0240456 A1 * 10/2008 Sakamoto ..... G10K 11/178 381/71.4
2009/0060217 A1 * 3/2009 Sakamoto ..... G10K 11/178 381/71.4
2010/0014685 A1 * 1/2010 Wurm ..... G10K 11/178 381/71.11
2010/0195844 A1 * 8/2010 Christoph ..... G10K 11/178 381/71.11
2011/0235693 A1 * 9/2011 Lee ..... H04S 7/00 375/224
2013/0044891 A1 * 2/2013 Obata ..... G10K 11/1786 381/71.4
2013/0129108 A1 * 5/2013 Wurm ..... G10K 11/16 381/71.11
2013/0136270 A1 * 5/2013 Sakamoto ..... G10K 11/16 381/71.4
2013/0188796 A1 * 7/2013 Kristensen ..... H04R 25/453 381/60
2013/0311040 A1 * 11/2013 Hasegawa ..... F16F 7/1011 701/36
2014/0103729 A1 * 4/2014 Uusimaki ..... H02J 3/385 307/86
2014/0126739 A1 5/2014 Yano
2014/0133229 A1 * 5/2014 Kamei ..... G11C 16/0483 365/185.11
2014/0133230 A1 * 5/2014 Kamei ..... G11C 16/28 365/185.11
2014/0133231 A1 * 5/2014 Kim ..... G11C 16/28 365/185.11
2015/0320481 A1 * 11/2015 Cosman, Jr. ..... A61B 18/1482 606/35
2016/0163304 A1 6/2016 Lee et al.
2016/0284337 A1 * 9/2016 Inoue ..... G10K 11/17883
2017/0076709 A1 * 3/2017 Ku ..... G10K 11/178
2017/0077906 A1 * 3/2017 Argyropoulos .... H03H 21/0012
2017/0178617 A1 * 6/2017 Christoph ..... G10K 11/1786
2017/0287462 A1 * 10/2017 Christoph ..... G10K 11/1788
2017/0287463 A1 * 10/2017 Christoph ..... G10K 11/1788
2018/0025717 A1 * 1/2018 Ku ..... G10K 11/178 381/71.11
2018/0070191 A1 * 3/2018 Chang ..... H04R 3/00

OTHER PUBLICATIONS

Liang Wang et al: "Convergence Analysis of Narrowband Feedback Active Noise Control System With Imperfect Secondary Path Estimation", IEEE Transactions on Audio, Speech and Language Processing, IEEE, vol. 21, No. 11, Nov. 1, 2013 (Nov. 1, 2013), pp. 2403-2411, XP011529559, ISSN: 1558-7916, DOI: 10.1109/TASL.2013.2277934 [retrieved on Oct. 15, 2013] * figure 1 * * p. 2407 *.
Extended european search report; EP 18156892.4; dated Aug. 1, 2018.

* cited by examiner

ACTIVE NOISE CONTROL USING VARIABLE STEP-SIZE ADAPTATION

BACKGROUND OF THE DISCLOSURE

1. Technical Field

This disclosure relates to processing signals and in particular, to a system and method that maintains stability and reduces low-frequency noise through variable step-size adaptations.

2. Related Art

Active noise control analyzes input signals and generates output signals to cancel undesired signals in a spatial sound field. Through feedback that returns a portion of the system's output to the system's input, the system maintains accuracy and stability in ideal and theoretical conditions. However, when acoustics change or when a noise occurs unexpectedly, the system may quickly converge to an extreme operating state that pushes the system into instability and causes it to generate noise, rather than suppressing the undesired signals. The noise may be more destructive than the undesired signals the system intends to cancel.

BRIEF DESCRIPTION OF THE DRAWINGS

This disclosure refers to the following drawings and descriptions. The components in the figures are not necessarily to scale, but illustrate the principles of the disclosure. Moreover, in the figures, like referenced numerals designate corresponding parts throughout the different views.

DETAILED DESCRIPTION

An active noise control system and method (referred to as the system(s) or ANC system(s)) actively reduces undesired sound within a specific spatial region, called the primary noise field, by adapting one or more secondary signals rendered from one or more transducers or loudspeakers that destructively interfere with the primary noise field. The secondary noise field rendered by the loudspeakers has roughly the inverse sound pressure polarity of the undesired primary noise field, which effectively reduces or substantially eliminates the primary noise field. The system generates the secondary signals by filtering one or more reference signals through one or more control filters. The control filters are dynamically adapting based on signals from one or more error microphones that are placed within the spatial region. The control filter adaptation is also dependent upon secondary path filters that are estimated a priori through a calibration process. This allows compensation for the delay and filtering created by the acoustic environment the system may operate within, such as the cabin of a vehicle, and the processing delays that may be inherent to the ANC system hardware and software. The adaptation is configured such that the error microphone signals in ideal conditions will tend towards zero over time, or towards some specified target sound. To ensure stability, the system adheres to one or more step size criteria that controls the adaption rate of the control filters.

Figure 1:
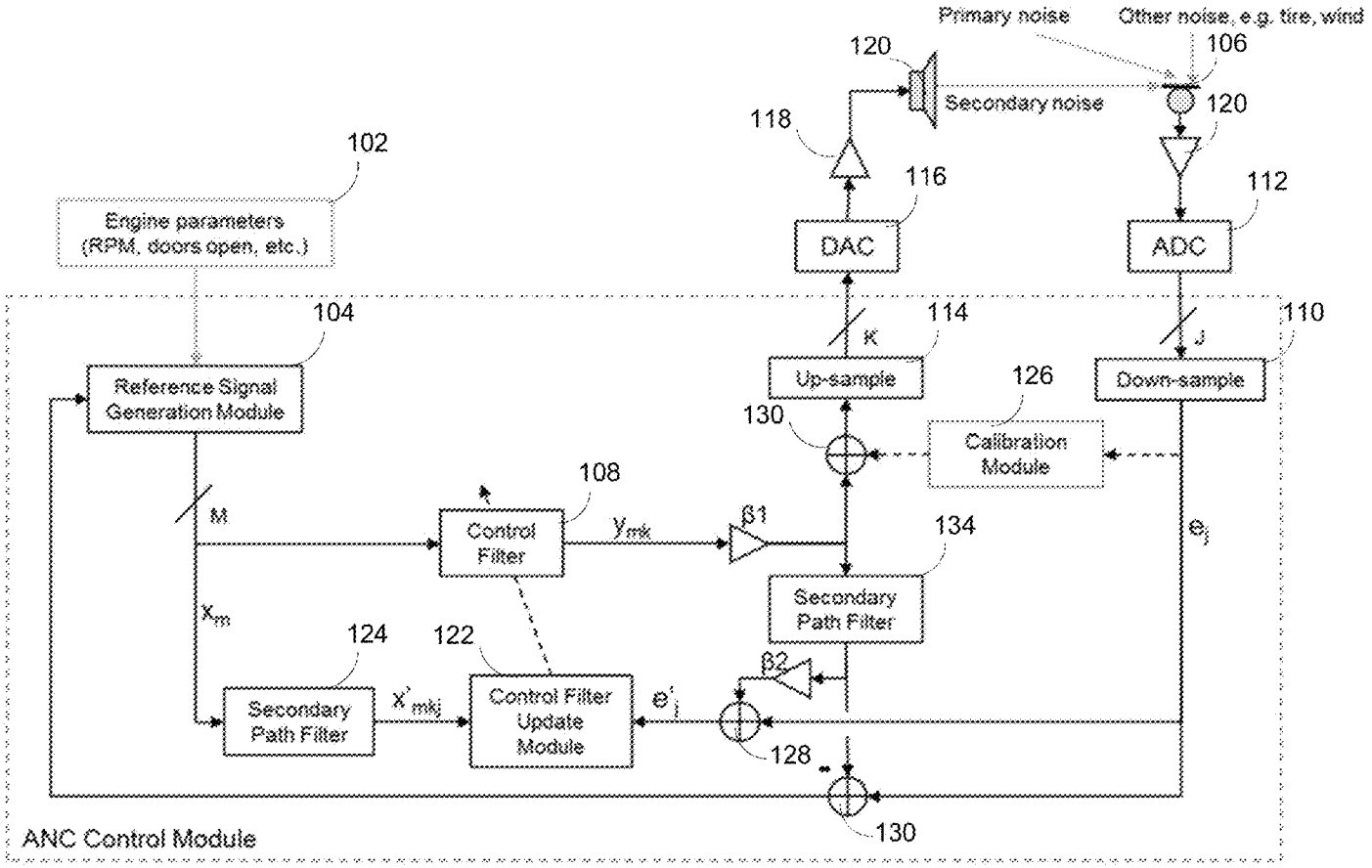
FIG. 1 is a block diagram of an active noise control system.

The ANC system of FIG. 1 is effective in combating undesirable low frequency engine noise generated by a vehicle without adding to the weight of the vehicle. As the engine speed changes (revolutions per second (RPS) or minute (RPM)) the vehicle generates different sounds that can be distracting or reduce the perception of the quality of the vehicle. In a vehicle environment, the vibrational and acoustic energy that is created by the engine is transferred into the vehicle cabin through various physical mechanisms. These include airborne paths through the air intake system or from the exhaust both internal and external to the vehicle, and through vibrational couplings between the engine and the vehicle chassis and subsequent structure-to-air couplings from different parts of the vehicle into the cabin. The sounds may be represented as engine orders with some engine orders being very strong relative to the other engine orders. In a four-stroke four-cylinder engine, for example, a vehicle may have a dominant second engine order due to the periodicity of the engine's operation. In a four-cylinder engine's first revolution, for example, cylinders one and three may fire; and in the second revolution, cylinders two and four may fire. This cycle creates four different detonations in two revolutions. This periodicity may make the second engine order more dominant than the other engine orders that the engine may create.

The ANC system of FIG. 1 may target different frequencies for different purposes. A driver may select various signal frequencies to suppress to emulate an expected driving environment (e.g., the driver may select a sport mode, a comfort mode, an economy mode, etc.) and/or the system may automatically select various frequencies or sounds to suppress. An input/output device (or processor) 102 handles some of the input operations of the ANC system that identifies the targeted signals to suppress or cancel such as the engine orders. Information may also be received from microphones 106, engine control units (ECUs), and the vehicle bus, such as a Controller Area Network (CAN bus). The ECUs monitor various in-vehicle sensors that monitor engine function and other vehicle functions that may render sound including air-fuel mixture, spark timing, idle speed, air management, exhaust gas recirculation, air conditioner clutch control, canister purge, electric fan control, torque converter clutch, back-up fuel, diagnostics, doors open, windows open, sunroof open, seat sensors, or any combination of these systems.

In response to detected signals or vehicle parameters such as RPM, a reference signal generation module 104 synthesizes M different reference signals. In FIG. 1, the reference letter that follow "/" represents the number of different channels the devices serve (e.g., /M refers to M channels). When executing engine order reductions, the reference signals may include a sum of pure tones at one or more engine order frequencies. The reference signals may include down-sampled signals received via the optional feedback loop. The down-sampled signals are generated from the one or more microphones 106 and may include a broadband noise component. The down-sampled signals are sourced by the down-sampler 110 that reduces the sampling rate of the digital audio signal rendered by ADC 112. In FIG. 1 the reference signal generation module 104 may render M complex reference signals as a function of time index n, x_m

[n]=a_m*exp(i Ω_m n), where a_m is the amplitude of the m-th sinusoid and Ω_m is the normalized frequency of the m-th sinusoid.

The reference signal generation module 104 feeds one or more control filters 108 that may comprise FIR filters or multiplicative complex gains. There are K*M control filters 108 in FIGS. 1 and 2. The control filters 108 modify the gain and phase of each M complex reference signals through its complex control coefficients that may be represented at time "n" as w_mk[n]. An optional amplifier β1 increases the amplitude of the control signals, y_mk, generated by control filters 108 before the sample size is increased by the up-sampler 114. The up-sampler 114 provides K channels of smooth digital signals to the digital-to-analog converter (DAC) 116. DAC 116 converts the digital audio signals into analog waveforms that is then processed by an optional audio amplifier 118 and converted into sound by loudspeakers 120.

Microphones 106 convert the acoustic sound field, which comprises the sum of primary and secondary sound fields, into electric signals. The J microphones 106 may have a flatter output response than narrowband microphones to detect the low frequency characteristics that are common to engine orders. An optional audio amplifier 120 amplifies the microphone signals before undergoing a digital conversion and down sampling rendering error signals e_1[*n*], e_2[*n*], . . . , e_j[n] (shown as $e_j$ in FIGS. 1 and 2).

Figure 2:
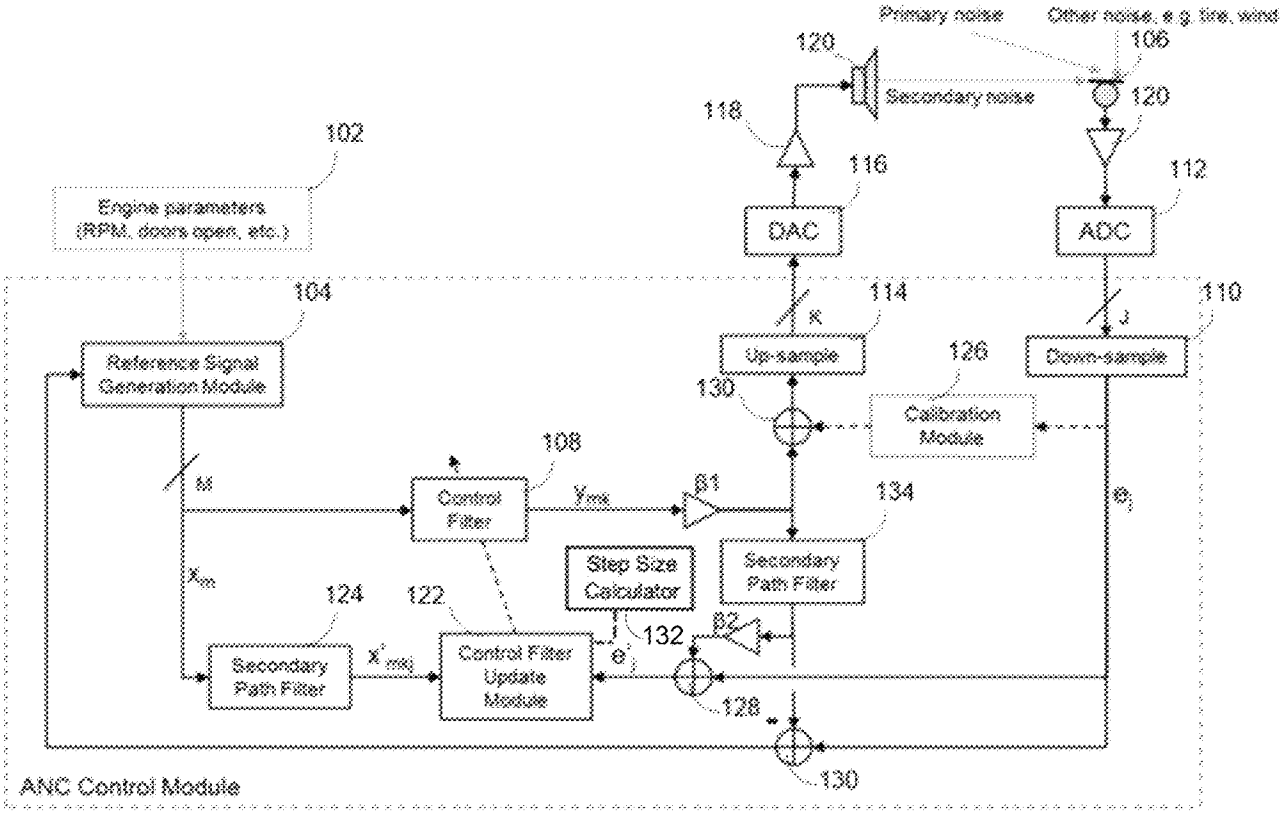
FIG. 2 is a block diagram of a second active noise control system.

Secondary path filter 124 filters the complex reference signals, x_m[n], to create secondary path filtered reference signals or "filtered-x" signals, x'_mkj[n] (shown as $x'_{mkj}$ in FIGS. 1 and 2). The secondary path filters 124 apply a secondary path transfer function or impulse response that estimates or models the acoustic paths from each independent control signal rendered from each loudspeaker 120 to each microphone 106. Secondary path filter 134 filters the control signals, y_mk, that is amplified by optional amplifier β2 and conditioned by an adder-subtractor 128.

A calibration module 126 and adder-subtractor 130 models the acoustic paths between the loudspeakers 120 and microphones 106 and hardware and/or software processing delays prior to run time (runs before the system is fully functional, e.g., in pre-production) in FIG. 1. The calibration module 126 transmits a calibration signal, for example, a controlled sweep signal, a Golay code or a random noise signal, through each loudspeaker 120 and measures or estimates the response at each microphone 106. The calibration module 126 estimates the acoustic coupling transfer function between each of the loudspeakers 106 and each of the microphones 106. This prior information is then stored in a memory and modeled as FIR filters or as multiplicative complex gains. In FIG. 1, the complex secondary path filter coefficients, s_kj, are stationary in time. In alternative systems, on-line calibration updates the FIR coefficients or multiplicative complex gains during run-time making the secondary path filter coefficients dynamic.

The control filter update module 122 controls the adaption rate of the control filters 108 by processing the pseudo error signals e'_j[n] (shown as $e'_j$ in FIGS. 1 and 2) and filtered-x signals, x'_mkj[n]. The control filter update module 122 generates successive complex control coefficients w_mk[n+1] and iteratively updates the control coefficients of the control filter 108 based on the previous complex control coefficients w_mk[n] values as expressed in EQ. 1 through a Filtered-x Least Mean Squares (FxLMS) algorithm:

$$w_mk[n+1]=w_mk[n]+mu*\Sigma_{j=1}^{J}x'_mkj[n]*e'_j[n] \quad \text{EQ. 1}$$

In EQ. 1, "w" designates the control filter coefficient (a complex value), "m" designates the engine order; "k" designates the loudspeaker index; "n" designates the time sample index; "mu" designates the step-size that controls the adaptation rate; and "j" designates the microphone index. In other words, by EQ. 1, the successive complex control coefficients w_mk[n+1] are the sum of the prior complex control coefficient w_mk[n] and the product of the filtered-x signals, x'_mkj[n], the pseudo error signals e'_j[n], and the step-size or tuning constant mu that controls the adaption rate of the control filter 108.

The step size or tuning constant of the control coefficients (referred to as step size(s) or adaptive step size(s)) effects the stability and the ability of the ANC system to converge quickly, e.g., during changing RPM/acceleration. If the step size is too small, the system may converge too slowly and signal cancellation may suffer. If the step size is too large, the system may converge too quickly causing the system to become unstable. To ensure the ANC's system stability and optimize the ANC system operation in dynamic vehicle conditions the step size may be limited to a theoretical maximum value expressed by EQ. 2.

$$mu_\max=1/(P_x'*(L+\text{Delta})) \quad \text{EQ. 2}$$

In EQ. 2, P_x'[n] designates the aggregated power of one or more filtered-x signals E{x'_mkj^2[n]}, L is the length of an FIR control filter, and Delta designates the number of samples corresponding to the delay in a secondary path (a scalar value). By EQ. 2, there is an inverse relationship between the step size and the amount of delay within the secondary paths. In other words, the more delay present in a secondary path within the acoustic environment, the smaller the maximum step-size, and the slower the ANC system adapts to the undesired signal, making the ANC system less effective. Based on the above inverse relationship to the power of the filtered-x signal, P_x'[n], the Normalized-FxLMS (FxNLMS) method maybe used instead of FxLMS to adapt the filter coefficients according to EQ. 3.

$$w_mk[n+1]=w_mk[n]+mu*=\Sigma_{j=1}^{J}x'_mkj[n]*e'_j[n]/P_x_j'[n] \quad \text{EQ. 3}$$

While EQ. 3 is theoretically stable with a suitable choice of scalar mu under ideal conditions, it relies upon on reasonably accurate estimates of the secondary path transfer functions used in computing the filtered-x signals x'_mkj[n]. Since in practice the secondary path transfer functions are dynamically varying, a scalar mu may result in an unstable system under certain conditions. Such conditions may include opening windows, sunroof or doors, faulty or obstructed microphones or loudspeakers, manufacturing variations between hardware components of the system, seats being repositioned or folded down, and varying number and seating positions of vehicle occupants. ANC systems employing a fixed step-size may have limited practical application. Some ANC systems may also use other variations on FxLMS such as Modified-FxLMS or filtered-u LMS, where a scalar step-size may experience the same robustness issues.

The FxNLMS algorithm with variable step-size adaptation is provided in EQ. 4:

$$w_mk[n+1]=w_mk[n]+\Sigma_{j=1}^{J}mu_mkj[n]x'_mkj[n]*e'_j[n]/P_x_j'[n] \quad \text{EQ. 4}$$

where mu_mkj[n] is a step-size that depends on the m-th reference signal/sinusoid, the k-th loudspeaker/control output channel and the j-th error microphone, and is varying with time index n. The step size may be modified by one or more step size criteria executed by the step size calculator 132 shown in FIG. 2. The step size calculator 132 informs the control filter update module 122 that renders the complex control coefficients. In FIG. 2, the step size calculator may apply one or more step size criteria.

A first step size criterion makes the step-size manually adjustable and/or variable in time and frequency. A manually tunable adaptation rate provides greater flexibility than a scalar step size in terms of the tradeoff between cancellation depth and convergence speed against stability and robustness at different frequencies. Under this step size criterion, a frequency dependent tunable step size factor may establish different adaptation rates across different frequency ranges. It may establish a slower adaptation rate at low aural frequency ranges and a higher adaptation rate at higher aural frequency ranges. In one use case, a user may establish an adaptive schedule that adapts the control coefficients at a very fast adaption rate relative to a steady state adaptation rate when an acceleration event occurs (detected via a polling or monitoring of the vehicle operating state via one or more ECUs or the vehicle bus). In this use case, a user may also reduce the adaption rate or step size to a steady state adaptive rate when a cruising speed event occurs. Under this step size criterion, if alpha (f) designates a frequency dependent tunable step size factor and "f" designates frequency, EQ. 5 expresses the step size criterion.

$$mu_mkj[n] \alpha \text{ alpha}[f_m[n]], \qquad \text{EQ. 5}$$

In EQ. 5, the step-size of the complex reference signals, mu_mkj[n] is proportional to the frequency dependent manually tunable step size factor. In EQ. 5, f_m[n] designates the frequency of the m-th reference signal at time "n" and alpha (f) is manually tunable through a graphical user interface (GUI) or a text interface. The user interfaces may establish and provide access to a codebook that stores a multidimensional performance map in memory. The memory also retains the software used to execute the adaptive algorithm of EQ. 5.

A second step size criterion establishes step sizes dependent on the estimated or measured secondary paths between the control outputs and the microphone inputs; that is the acoustic delay from each loudspeaker to each microphone. This alternate step size criterion makes the step sizes of the complex reference signals, mu_mkj[n] inversely proportional to the secondary path delay at frequency f_m[n] from loudspeaker "k" to microphone "j" as expressed in EQ. 6.

$$mu_mkj[n] \alpha 1/\text{Delta}_mkj \qquad \text{EQ. 6}$$

In EQ. 6, Delta_mkj is the secondary path delay at frequency f_m[n] from loudspeaker "k" to microphone "j". The secondary path transfer functions are measured or estimated by the calibration module 126. Calibration module 126 may also measure or estimate phase delay or group delay from the phase response of each secondary path across a swept frequency range. In other words, the ANC system measures the delay at any given frequency knowing the delay of each of the secondary paths. So rather than using a scalar delta to calculate a maximum step-size as in EQ. 2, this adaptive algorithm creates a step size that is frequency dependent on each loudspeaker to microphone combination.

When executing the adaptive algorithm of EQ. 6, the secondary path impulse responses are transformed into the complex frequency domain using a Discrete Fourier Transform (DFT), Discrete Cosine Transform (DCT) or another method. After system calibration, the secondary path delay at frequency f_m[n] from loudspeaker "k" to microphone "j", Delta_mkj, is measured or estimated. When nulls in the measured or estimated secondary path occurs (e.g., the secondary paths may be represented by transfer functions) or it is difficult to measure or estimate group or phase delay accurately, this adaptive algorithm executes a smoothing or interpolation process across a portion of or the entire frequency range. In some systems, the measurements/estimates are stored in a codebook as multidimensional performance maps (called a modified look-up table) that are associated with the corresponding frequencies that lie within the frequency range.

A third step size criterion provides a "fail-safe" mechanism that maintains a design safe state when the ANC system converges to an unstable state. This alternate step size criterion prevents the amplitude of the control signals, y_mk, from becoming excessive, which may introduce a harmful level of noise into the enclosed space (e.g., the vehicle cabin). Under this step size criterion, the adaptive algorithm may establish a threshold that limits the output for each engine order the ANC system is targeting. The tunable limiter threshold is frequency dependent and may correspond to each loudspeaker, "k", as expressed in EQ. 7.

$$\text{thresh}_mk = \text{thresh}_k(f_m[n]) \qquad \text{EQ. 7}$$

In EQ. 7, "k" designates the loudspeaker/control channel; "m" designates the engine order; and "n" designates time index. Let g_mk[n] designate the magnitude (or energy) of the control signal corresponding to loudspeaker "k". Under this step size criterion the step size of the complex reference signals, mu_mkj[n], is directly proportional to a temporal function of the prior control signals, T(beta_mk[n−N], . . . , beta_mk[n−1], beta_mk[n]), as expressed in EQ. 8.

$$mu_mkj[n] \alpha T(\text{beta}_mk[n-N], \ldots, \text{beta}_mk[n-1], \text{beta}_mk[n]) \qquad \text{EQ. 8}$$

In EQ. 8, the temporal function of the prior control signals, T(beta_mk[n]), may be defined by the threshold conditions expressed by EQ. 9.

$$\text{where beta_mk}[n] = \begin{cases} 0 & ; \text{g_mk}[n] >= \text{thresh_mk} \\ 1 & ; \text{g_mk}[n] < \text{thresh_mk} \end{cases} \qquad \text{EQ. 9}$$

In EQ. 8 and 9, T(x) is a temporal function that reflects the historical magnitudes (or energy) of the control signals. For example, this adaptive algorithm may process prior values of beta_mk[n], for n=0, 1, 2, etc. and set the step size to zero indefinitely or for a specified period of time or when a threshold (also referred to as a limiter threshold) is first exceeded. In an alternate system, the temporal function of the prior control signals beta_mk[n] is a non-binary value. For example, in some systems beta_mk[n] may decrease proportionally as the energy of the control signal g_mk[n] approaches a predetermined threshold value associated with the engine order and the loudspeaker index, thresh_mk. This "fail-safe" step size criterion provides a tunable frequency and loudspeaker-dependent limiter threshold that provides greater flexibility than a scalar limiter. The criterion optimizes the tradeoff of cancellation during normal operation versus protection against instability.

A fourth step size criterion bypasses the adaption process based on the output of one or more step size calculators. Under this criterion, the ANC system customizes the adaption rates in response to different divergences or types of instability or abnormalities detected. Under this criterion, the step size calculators control the step size. For example, a step size calculator may stop the adaptation of the control coefficients and disable the ANC system output as soon as instability is detected. EQ. 10 expresses this criterion where gamma_mkj[n] represents the step size calculator at time index "n".

$$\text{mu_mkj}[n]\alpha \quad \text{EQ. 10}$$

$$T(\text{gamma_mkj}[n\text{-}N], \ldots, \text{gamma_mkj}[n\text{-}1], \text{gamma_mkj}[n])$$

where gamma_mkj[$n$] =

0; microphone $j$ is broken

0; loudspeaker $k$ is broken

0; another predefined or customized condition is detected

1; otherwise

In this step size criterion, a malfunctioning microphone is detected by comparing the energy of the microphone signal to an expected energy level. In other words, the systems compare the energy of each microphone signal to the microphone energy each microphone produces during normal functioning in and of itself, when no sound is present (e.g., a microphone self-noise or a predetermined microphone threshold). A loudspeaker malfunction may be detected by measuring continuity, the current draw of each loudspeaker, or the equivalent impedance of each loudspeaker.

An alternate step size calculator monitors the complex control filter coefficients over time to determine when an unstable condition occurs. Using a correlator or correlation detector, divergence is detected by monitoring the energy of the control output signals and the energy of the microphone signals. When the energy in both signals are increasing simultaneously for a sufficient period of time, a divergence is detected and the ANC system may be disabled or alternately, the step size modified or disabled. Some ANC system execute this comparison in the frequency domain at each of the specific frequencies that the ANC system is generating. An alternate correlator monitors or tracks the variance of the complex control filter coefficients over time (e.g., it's gain, phase, or gain's or phase's variance). A prolonged high variance level (e.g., a variance that exceeds a predetermined operating threshold) also identifies divergence that in some systems is also based on the operating state of the vehicle. For example, when the ECUs indicate that the engine operating conditions are static, e.g., running at a constant RPM and/or throttle position, the iterative change of the complex coefficients should reflect a low variance.

Figure 3:
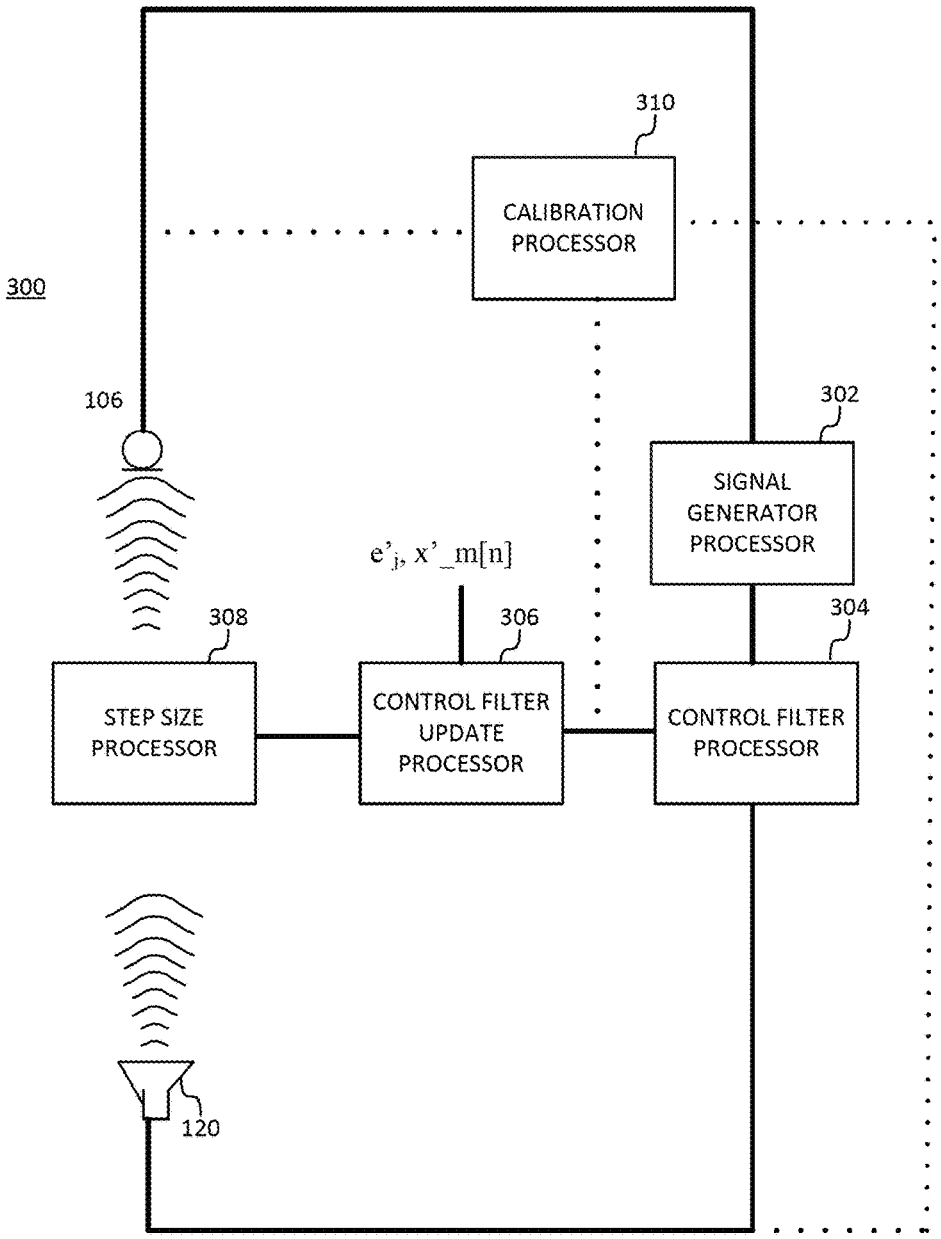
FIG. 3 is a representation of a third active noise control system.

FIG. 3 is a schematic representation of a third active noise control system 300 that enhances noise reduction in an audio enclosure or a vehicle. The example system includes one or more microphones 106, one or more audio transducers 120, a signal generator processor 302, a control filter processor 304, a control filter update processor 306, a step size processor 308, and an optional calibration processor 310.

The one or more microphones 106 may capture the primary and secondary noise within the enclosed space (e.g., the vehicle cabin). The signal generator processor 302 synthesizes M different reference signals, x_m[n], or sinusoids in response to the monitored noise from external sources or vehicle parameters such as RPM, the opening and/or closing of doors and/or windows, etc. The control filter processor 304 modifies the gain and phase of each M complex reference signals through its complex control coefficients. The control filter update processor 306 controls the adaption rate of the control filters 108 by processing the modified error signals $e'_j$ (the pseudo error signal shown in FIGS. 1 and 2) and filtered-x signals, x'_mkj[n] in response to the step size processor 308. The step size processor 308 applies one or more step size criteria/criterion described above to modify the adaptation rate applied by the control filter update processor 306 optimizing the ANC's performance and stability.

The optional calibration processor 310 renders and generates a controlled sweep signal or a random noise signal transmitted from each transducer 120 to each microphone 106 to estimate the acoustic coupling between the transducer 120 and microphone 106. The optional calibration processor 310 runs before the process is fully functional, e.g., in pre-production. When operational, the optional calibration processor 310 measures or estimates the acoustic coupling transfer functions (also referred to as the secondary path transfer functions) from each transducer 120 to each microphone 106. Using the measured or estimated acoustic coupling transfer functions (reflected in the filtered-x signals, x'_mkj[n]), the process accurately compensates for the delay created by the small acoustic environment the process may operate within (e.g., vehicle cabin) and the signal propagation delays that may be inherent to executing the process.

Figure 4:
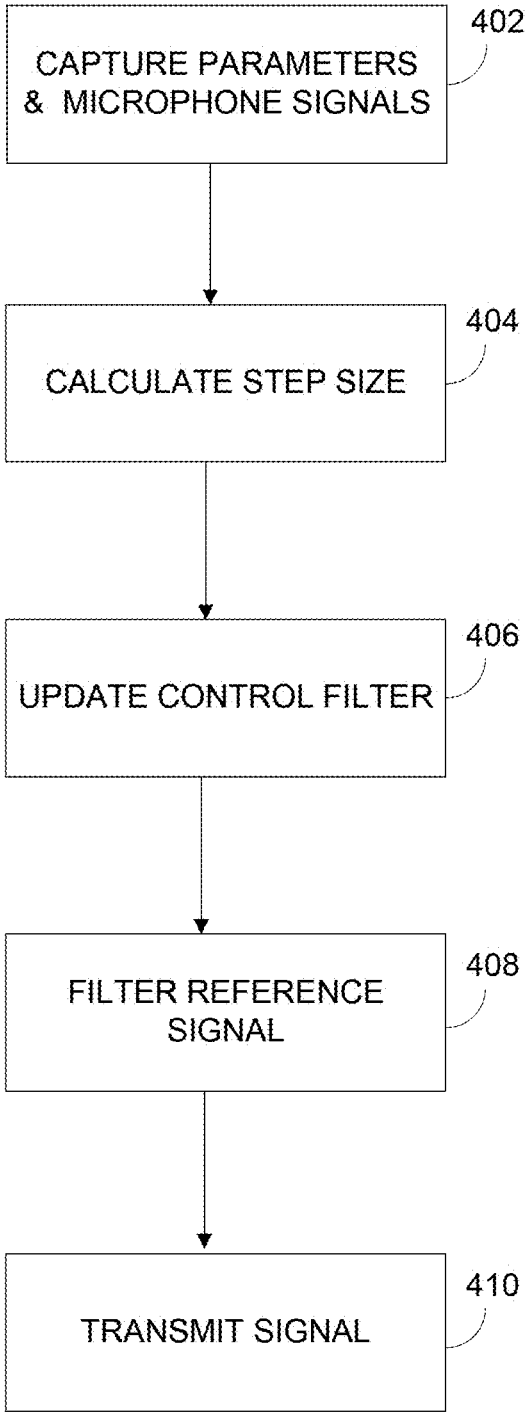
FIG. 4 is a process for actively reducing noise.

FIG. 4 is a process that actively reduces noise. The process may be implemented using any of the systems described herein with reference to FIGS. 1-3. The process actively reduces undesired sound within a targeted spatial region (e.g., the vehicle cabin), called the primary sound field, by adapting one or more secondary signals rendered from one or more transducers or loudspeakers to create a secondary sound field that has roughly an inverted polarity with respect to the primary sound field. This results in destructive interference between the primary sound field and secondary sound field. The process reduces undesired sound by capturing microphone signals within the targeted region and external or vehicle parameters such as the RPM, the opening and/or closing of doors and/or windows, etc. at 402. The process calculates the rate the control filters adapt to the undesired targeted sound by applying one or more of the step size criteria described above at 404. By processing the modified or pseudo error signals and the filtered-x signals, the control filter's complex control coefficients are updated at 406. The control filter modifies the gain and phase of one or more complex reference signals at 408 through its updated complex control coefficients before the filtered control signals are converted into sound at 410.

Figure 5:
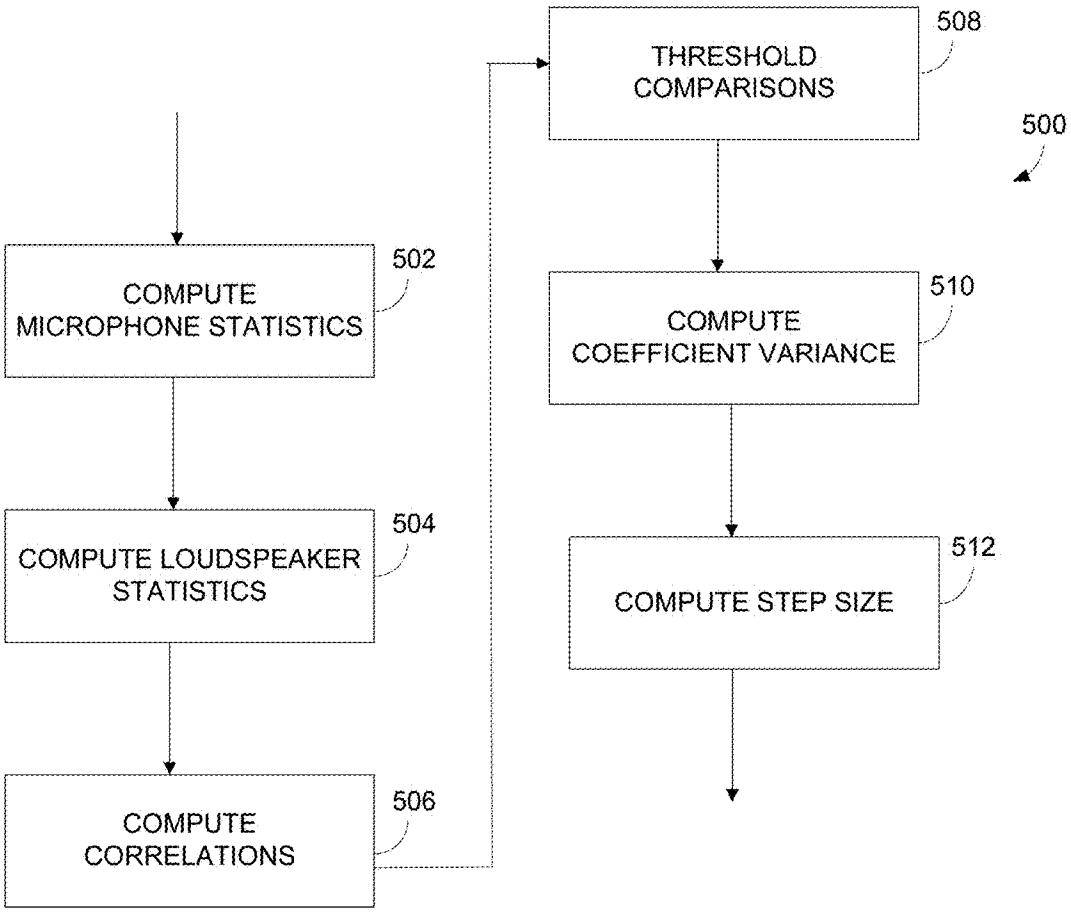
FIG. 5 is a process for calculating an adaptation step size.

Prior to calculating the step size in FIGS. 4 and 5, an optional calibration process may model the acoustic paths between the loudspeakers and microphones and hardware and/or software processing delays prior to run time. When operational, the optional calibration process measures or estimates the acoustic coupling transfer functions from each transducer to each microphone, and may measure phase delay and/or group delay as a function of frequency. The transfer functions may be represented as impulse responses or in the frequency domain using a Discrete Fourier Transform (DFT) or related method. The transfer functions are used to filter the reference signals to create the filtered-x signals used in the complex control coefficient update, and are used optionally to filter the control signals when creating the pseudo-error signals. This process accurately compensates for the delay created by the acoustic environment and the delays inherent to executing the process.

FIG. 5 is a process that calculates the step size 500 using a combination of the step size criteria. While select step size criteria are processed in a specific sequence in FIG. 5, alternate processes execute all other possible sequences and combinations including all of the step size criteria described above in any order.

In FIG. 5, the process computes microphone and loudspeaker statistics at 502 and 504. The statistics may reflect the amount of energy in the control signals, y_mk, (that reflects the energy in the loudspeaker signal) and the error signals $e_j$ (that reflects the energy in the microphone signals). The process measures the strength and direction of the relationship between energy in the control signals and energy in the microphone signals thorough a statistical correlator. A strong positive statistical correlation in both directions (indicating the extent to which those variables increase or decrease in parallel) above a predetermined level is identified as a divergence at 506. The energy in the control signals and microphone signals, and the correlation between the two, may also be computed as a function of frequency, for example using a Discrete Fourier Transform (DFT). A divergence may therefore be identified when both the energy in the control signals and the energy in the microphone signals is increasing over a specified period of time at a specific engine order or frequency. The gain associated with the complex control coefficients for a given engine order and loudspeaker are compared to respective thresholds at 508. When the gain of the complex control coefficients exceeds the threshold, a divergence is identified at 508. When the energy in the error signals does not exceed the energy of the microphone's own self-noise threshold, a divergence is also identified at 508. When the control signals exceed a control signal threshold (indicating a loudspeaker short), and/or a loudspeaker failure is indicated by other means such as the current drawn by the loudspeaker, then a divergence is identified at 508. At 510 the process measures the variance of the complex control filter coefficients over time (e.g., it gains, phase, or gains' variance). A variance that exceeds a predetermined threshold, which may be partly determined by vehicle parameters such as RPM, identifies a divergence. At 512, the step size used to adapt the complex control coefficients to the targeted signal is computed. When divergence is detected, the adaptive algorithms associated with the detected divergence modify the adaption rate of the process. In alternate processes, the adaption rates are modified by a combination of the adaptive algorithms. The process may modify the adaptation rate based on a defined temporal function of the step size calculator. For example, a divergence may persist for a specified period of time or until a condition on a vehicle parameter is met, or alternatively if divergence has been detected more than a specified number of times, then the adaptation rate may be set to zero permanently and a diagnostic code may be issued.

Figure 6:
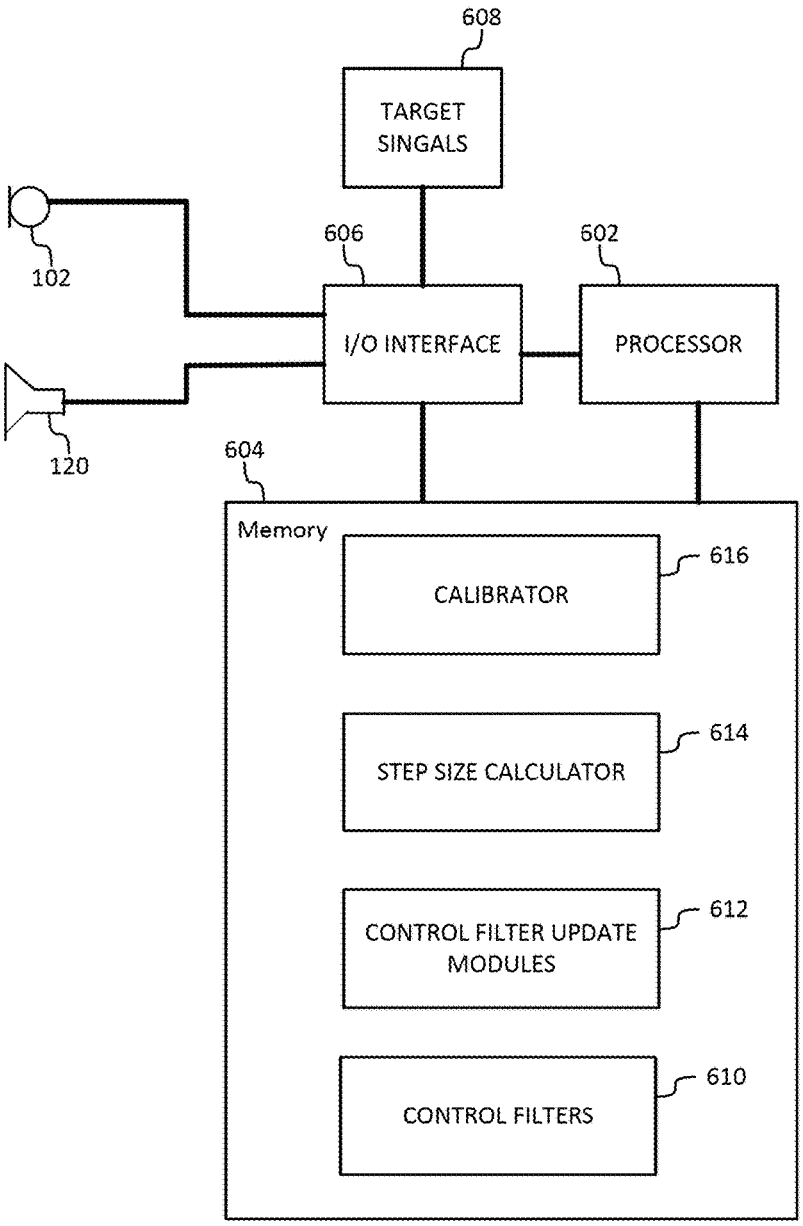
FIG. 6 is a block diagram of a fourth active noise control system.

FIG. 6 is a block diagram of a fourth active noise control system. The system comprises a processor 602, a non-transitory media such as a memory 604 (the contents of which are accessible by the processor 602) and an I/O interface 606. The I/O interface 606 may be used to connect devices such as, for example, additional microphones, audio transducers or loudspeakers, and receive the target signal inputs 608. The memory 604 may store instructions which when executed by the processor 602 causes the system to render some or all of the functionality associated with the systems described herein. For example, the memory 604 may store instructions which when executed by the processor 602 causes the system to reduce undesired signals through the control filters 610, the control filter update modules 612, the optional calibrator 616 and/or some or all combinations of the divergence detection or step size calculators 614 described above. In addition, data structures, temporary variables and other information may store data in data storage.

The processor 602 may comprise a single processor or multiple processors that may be disposed on a single chip, on multiple devices or distributed over more than one system. The processor 602 may be hardware that executes computer executable instructions or computer code embodied in the memory 604 or in other memory to perform one or more features of the ANC system. The processor 602 may include a central processing unit (CPU), a graphics processing unit (GPU), an application specific integrated circuit (ASIC), a digital signal processor (DSP), a field programmable gate array (FPGA), a digital circuit, an analog circuit, a microcontroller, any other type of processor, or any combination thereof.

The memory 604 or storage disclosed may retain an ordered listing of executable instructions for implementing the functions described above. The machine-readable medium may selectively be, but not limited to, an electronic, a magnetic, an optical, an electromagnetic, an infrared, or a semiconductor medium. A non-exhaustive list of examples of a machine-readable medium includes: a portable magnetic or optical disk, a volatile memory, such as a Random Access Memory (RAM), a Read-Only Memory (ROM), an Erasable Programmable Read-Only Memory (EPROM or Flash memory), or a database management system. The memory 604 may comprise a single device or multiple devices that may be disposed on one or more dedicated memory devices or on a processor or other similar device. When functions or steps are said to be "responsive to" or occur "in response to" a function or a process, the device functions or steps necessarily occur as a result of (or because of) the function. It is not sufficient that a function or act merely follow or occur subsequent to another.

The memory 604 may also store computer code, such as the signal generator processor 302, the control filter processor 304, the control filter update processor 306, the step size processor 308, and the optional calibration processor 310. The computer code may include instructions executable with the processor 602. The computer code may be written in any computer language, such as C, C++, assembly language, channel program code, and/or any combination of computer languages. The memory 604 may store information in data structures and algorithms including, for example, one or more of the adaptive algorithms, statistical correlators, step sizes, the codebooks, the multidimensional performance maps, adaptive schedules, threshold conditions and outcomes, loudspeaker and microphone operating characteristics, calibrations, etc.

The functions, acts or tasks illustrated in the figures or described may be executed in response to one or more sets of logic or instructions stored in or on non-transitory computer readable media as well. The functions, acts or tasks are independent of the particular type of instructions set, storage media, processor or processing strategy and may be performed by software, hardware, integrated circuits, firmware, micro code and the like, operating alone or in combination. In one embodiment, the instructions are stored on a removable media device for reading by local or remote systems. In other embodiments, the logic or instructions are stored in a remote location for transfer through a computer network or over wireless or tangible telephone or communication lines. In yet other embodiments, the logic or instructions may be stored within a given computer such as, for example, a CPU.

The disclosed system and process reinforces speech naturally without distortion or added noise in a vehicle cabin and may further include the systems and methods described in U.S. Ser. No. 14/245,142, titled Active Noise Equalization, the disclosure of which is incorporated by reference. A vehicle may comprise, without limitation, a car, bus, truck, tractor, motorcycle, bicycle, tricycle, quadricycle, or other cycle, ship, submarine, boat or other watercraft, helicopter, drone, airplane or other aircraft, train, tram or other railed vehicle, spaceplane or other spacecraft, and any other type of vehicle whether currently existing or after-arising this disclosure. In other words, it comprises a device or structure for transporting persons or things.

The system is fully automated such that the secondary signals are continuously adapted to mitigate the targeted signal or noise level within the vehicle cabin. The application of group/phase delay of secondary paths, statistical correlation over time between control outputs signal energies and microphone input energies, variance of control coefficients, and/or limiting the comparative amplitude of the secondary signals occurs automatically as different acoustical environments occur and are detected. The systems operate at low delay so vehicle occupants do not perceive the cancellation of an undesired aural signal. The low delay operation of the system reinforces a driver's vehicle mode selection so that is does not perceptibly interfere with desired sound of a selected mode. The system is unaffected by the simultaneous or concurrent operation of each of divergence detection criterion—meaning any combination of step size criteria or parallel systems may operate simultaneously or concurrently. The system operates in musical environments and does not cause any perceptible distortion to music or other media. The system can be implemented on or within other in-car systems such as an infotainment processor and digital signal processors or DSPs and co-exist with other system software. The system quickly adapts to different vehicle and cabin types and different acoustic configurations.

Other systems, methods, features and advantages will be, or will become, apparent to one with skill in the art upon examination of the figures and detailed description. It is intended that all such additional systems, methods, features and advantages be included within this description, be within the scope of the disclosure, and be protected by the following claims.

What is claimed is:

1. A method that actively cancels noise in a vehicle using a plurality of microphones and a plurality of loudspeakers comprising:

generating one or more control output signals to drive the plurality of loudspeakers; and adapting a plurality of control coefficients of a control filter based on a plurality of secondary path transfer functions that model the acoustic paths between each loudspeaker and each microphone of the plurality of microphones;

where the rate the plurality of control coefficients of the control filter adapt is time-varying and frequency dependent; and where the rate the plurality of control coefficients of the control filter adapt is based on an adaptive step size based on a predetermined secondary acoustic path.

2. The method of claim 1 where the plurality of secondary path transfer functions are measured by transmitting a signal through each of the plurality of loudspeakers and measuring the audio response at each of the plurality of microphones.

3. The method of claim 1 further comprising estimating a frequency-dependent group delay from the plurality of secondary path transfer functions.

4. The method of claim 3 where the adaptive step size is inversely related to the frequency-dependent group delay.

5. The method of claim 1 further comprising estimating a frequency-dependent phase delay from the plurality of secondary path transfer functions.

6. The method of claim 1 where the adaptive step size is inversely related to the frequency-dependent phase delay.

7. The method of claim 1 further comprising estimating an overall delay from the plurality of secondary path transfer functions.

8. The method of claim 7 where the adaptive step size is inversely related to the estimated overall delay.

9. The method of claim 1 where the adaptive step size is based on the predetermined secondary acoustic path and step size criterion.

10. A non-transitory machine-readable medium encoded with machine-executable instructions, where execution of the machine-executable instructions:

generates one or more control output signals to drive a plurality of loudspeakers; and adapts a plurality of control coefficients of a control filter based on a plurality of secondary path transfer functions that model the acoustic paths between each loudspeaker and a plurality of microphones;

where the rate the plurality of control coefficients of the control filter adapt is time-varying and frequency dependent; and where the rate the plurality of control coefficients of the control filter adapt is based on an adaptive step size based on a step size criterion.

11. The non-transitory machine-readable medium of claim 10 where the step size criterion comprises one or more energy thresholds that are compared to the energies of the control output signals generated by the control filter.

12. The non-transitory machine-readable medium of claim 10 where the step size criterion comprises separate energy thresholds that are compared to different components of the control output signals generated by the control filter that are associated with individual engine orders.

13. The non-transitory machine-readable medium of claim 10 further comprising ceasing the adaption of the plurality of control coefficients of the control filter when the energy level of a control output signal generated by the control filter exceeds an energy threshold.

14. The non-transitory machine-readable medium of claim 10 where the step size criterion comprises set energy thresholds dependent on a vehicle's operating state.

15. The non-transitory machine-readable medium of claim 14 where the vehicle's operating state is measured by the revolutions per minute of the vehicle's engine.

16. The non-transitory machine-readable medium of claim 10 where the step size criterion comprises microphone self-noise.

17. The non-transitory machine-readable medium of claim 10 where the step size criterion is based on an electric current draw of each loudspeaker or an impedance of each loudspeaker.

18. The non-transitory machine-readable medium of claim 10 where the step size criterion comprises a measure of correlation over time between control output signals generated by the control filter and each of a plurality of microphone input signals.

19. The non-transitory machine-readable medium of claim 10 where the step size criterion comprises a predetermined measure of statistical variance of the plurality of control coefficients of the control filter.

20. The non-transitory machine-readable medium of claim 10 where the step size criterion comprises two or more step size criteria based on:

a group delay or a phase delay of the acoustic paths between each loudspeaker and each microphone;

a measure of correlation over time between control output signals generated by the control filter and each of a plurality of microphone input signals;

a comparison of control output signal energies to predetermined thresholds; or a predetermined measure of statistical variance of the plurality of control coefficients of the control filter.

21. An active noise control system comprising:

control filter means that generates one or more control output signals to drive a plurality of loudspeakers in response to an external audio source; and control filter update means that adapts a plurality of control coefficients of the control filter means based on a plurality of secondary path transfer functions that model the acoustic paths between a plurality of loudspeakers and a plurality of microphones; and divergence detection means that controls the adaption rate of the plurality of control coefficients in response to a step size criteria;

where the plurality of plurality control coefficients are time varying and frequency dependent.

* * * * *